US008024862B2

(12) United States Patent
Morisugi et al.

(10) Patent No.: US 8,024,862 B2
(45) Date of Patent: Sep. 27, 2011

(54) HAIR CLIPPER

(75) Inventors: Kazuhiro Morisugi, Inukami (JP); Toshio Ikuta, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 782 days.

(21) Appl. No.: 11/987,941

(22) Filed: Dec. 6, 2007

(65) Prior Publication Data

US 2008/0134516 A1 Jun. 12, 2008

(30) Foreign Application Priority Data

Dec. 11, 2006 (JP) ..... 2006-333627

(51) Int. Cl.
*B26B 19/02* (2006.01)

(52) U.S. Cl. ..... 30/43.92; 30/208; 30/223

(58) Field of Classification Search ..... 30/208–210, 30/215, 216, 220–224, 43.7–43.92
See application file for complete search history.

(56) References Cited

U.S. PATENT DOCUMENTS

| | | | | |
|---|---|---|---|---|
| 3,052,025 | A * | 9/1962 | Ring | 30/221 |
| 3,561,116 | A * | 2/1971 | Wahl | 30/220 |
| 3,747,212 | A * | 7/1973 | Krayl | 30/221 |
| 3,962,785 | A | 6/1976 | Poel | |
| 3,992,778 | A * | 11/1976 | Urbush | 30/216 |
| 4,249,307 | A * | 2/1981 | Andis | 30/216 |
| 4,328,616 | A * | 5/1982 | Andis | 30/216 |
| 4,458,417 | A | 7/1984 | Andis | |
| 4,512,077 | A | 4/1985 | Tanabe et al. | |
| 5,088,200 | A * | 2/1992 | Piwaron et al. | 30/43.92 |
| 5,325,590 | A * | 7/1994 | Andis et al. | 30/43.92 |
| 5,504,997 | A * | 4/1996 | Lee | 30/43.92 |
| 5,544,415 | A * | 8/1996 | Huang | 30/43.92 |
| 6,308,415 | B1 * | 10/2001 | Sablatschan et al. | 30/43.92 |
| 6,393,702 | B1 * | 5/2002 | Laube | 30/223 |
| 6,421,922 | B2 * | 7/2002 | Beutel et al. | 30/216 |
| 6,473,973 | B2 * | 11/2002 | Laube | 30/223 |
| 6,490,798 | B2 * | 12/2002 | Morisugi et al. | 30/216 |
| 6,862,810 | B2 * | 3/2005 | Braun et al. | 30/210 |
| 6,886,255 | B2 * | 5/2005 | Freas et al. | 30/43.91 |
| 6,895,673 | B2 * | 5/2005 | O | 30/224 |
| 6,901,664 | B2 * | 6/2005 | Melton et al. | 30/210 |
| 6,935,029 | B2 * | 8/2005 | Morisugi et al. | 30/43.92 |
| 7,010,859 | B2 * | 3/2006 | Laube | 30/223 |
| 7,080,458 | B2 * | 7/2006 | Andis | 30/223 |
| 7,340,839 | B2 * | 3/2008 | Oh | 30/210 |
| 7,624,506 | B2 * | 12/2009 | Melton et al. | 30/216 |
| 7,748,123 | B2 * | 7/2010 | Bednar | 30/216 |
| 7,762,001 | B2 * | 7/2010 | Morisugi et al. | 30/216 |
| 2003/0005585 | A1 * | 1/2003 | Rizzuto et al. | 30/43.92 |
| 2005/0011076 | A1 * | 1/2005 | Andis | 30/223 |
| 2006/0042096 | A1 * | 3/2006 | Liao | 30/223 |
| 2006/0230621 | A1 * | 10/2006 | Liao | 30/223 |
| 2007/0044604 | A1 * | 3/2007 | Andis et al. | 30/43.91 |
| 2007/0289144 | A1 * | 12/2007 | Morisugi et al. | 30/216 |
| 2008/0168661 | A1 * | 7/2008 | Lau | 30/216 |
| 2008/0282550 | A1 * | 11/2008 | Piwaron | 30/210 |
| 2009/0056143 | A1 * | 3/2009 | Fukutani et al. | 30/43.92 |
| 2009/0144988 | A1 * | 6/2009 | Lau | 30/208 |
| 2009/0320296 | A1 * | 12/2009 | Morisugi et al. | 30/43.92 |
| 2010/0000093 | A1 * | 1/2010 | Hwang | 30/43 |

FOREIGN PATENT DOCUMENTS

EP 1120206 A1 * 8/2001

(Continued)

*Primary Examiner* — Jason Daniel Prone

(74) *Attorney, Agent, or Firm* — Bacon & Thomas, PLLC

(57) ABSTRACT

A hair clipper has a blade block, which includes a fixed blade, a movable blade overlapped with the fixed blade to make sliding contact with the fixed blade, a pressing spring applying a pressing load to maintain a uniform contact pressure between the fixed blade and the movable blade, and a blade base for receiving and retaining the fixed blade and the movable blade and the pressing spring. The blade base has a blade holder retaining the fixed blade and the movable blade and a blade cover attached to the blade holder to cover the fixed blade and the movable blade. Further, the blade holder has a primary retainer member holding end portions of the pressing spring and the blade cover has a secondary retainer member pressing the end portions of the pressing spring in a direction in which the pressing spring is retained by the primary retainer member.

7 Claims, 13 Drawing Sheets

FOREIGN PATENT DOCUMENTS

| | | | | |
|---|---|---|---|---|
| EP | 1867446 | A1 | * | 12/2007 |
| EP | 1932633 | A1 | * | 6/2008 |
| EP | 1935586 | A1 | * | 6/2008 |
| EP | 2030743 | A1 | * | 3/2009 |
| GB | 2113596 | | | 8/1983 |
| JP | 02-001078 | | | 1/1990 |
| JP | 06190158 | A | * | 7/1994 |
| JP | 06285272 | A | * | 10/1994 |
| JP | 10-235036 | | | 9/1998 |
| JP | 2001204979 | A | * | 7/2001 |
| JP | 2005261486 | A | * | 9/2005 |
| JP | 2007-209612 | | | 8/2007 |
| JP | 2008142344 | A | * | 6/2008 |
| JP | 2008154765 | A | * | 7/2008 |
| JP | 2009050496 | A | * | 3/2009 |
| JP | 2010213832 | A | * | 9/2010 |
| NL | 7404738 | | | 10/1975 |

* cited by examiner

HAIR CLIPPER

FIELD OF THE INVENTION

The present invention relates to a hair clipper having a blade block and, more particularly, to a technique of reliably retaining, in a blade base, a pressing spring applying a pressing load to a movable blade against a fixed blade.

BACKGROUND OF THE INVENTION

Conventionally, in this kind of hair clipper blade block, a pressing spring which serves to press a movable blade against a fixed blade is normally held in a blade base by fitting bosses provided inside the blade base to boss-holes formed at end portions of the pressing spring and then upsetting or deforming exposed free ends of the boss by cold or hot working. There is also known an alternative method of press fitting a pressing spring to groove portions provided in a blade base (see, e.g., Japanese Patent Laid-open Application No. 10-235036).

In case the pressing spring is fixed by upsetting the bosses as in the prior art, the pressing spring may be retained in a floating state (i.e., the boss holes of the pressing spring may be movable along the axial directions of the bosses) due to processing errors generated by the upsetting process. Further, the reaction force of the pressing spring acts on the deformed bosses all the time. Therefore, if the hair clipper is exposed to elevated temperatures while being circulated in the market or while being used, the deformed bosses may undergo creep deformation and thus the pressing spring may often suffers from floating. This holds true in case of the prior art example in which the pressing spring is press fitted to the groove portions provided in the blade base.

For the reasons noted above, the pressing force of the pressing spring is weak in the prior art hair clipper, which reduces the contact pressure between the fixed blade and the movable blade and thus leaves a gap between the edge portions of the comb-shaped movable and fixed blades. This poses a problem in that the cutting performance of the blade block is impaired and the lifespan of the blade block is reduced depending on the environment in which the hair clipper is used.

SUMMARY OF THE INVENTION

In view of the above, the present invention provides a hair clipper having a blade block that allows a pressing spring to stably apply a pressing load to a movable blade against a fixed blade, thereby improving the cutting performance of a hair clipper. Further, the blade block of the invention is strong, robust, and durable even in unfriendly environment.

In accordance with an embodiment of the present invention, there is provided a hair clipper having a blade block, the blade block including: a fixed blade; a movable blade overlapped with the fixed blade to make sliding contact with the fixed blade; a pressing spring applying a pressing load to maintain a uniform contact pressure between the fixed blade and the movable blade; and a blade base for receiving and retaining the fixed blade and the movable blade and the pressing spring, wherein the blade base includes a blade holder retaining the fixed blade and the movable blade and a blade cover attached to the blade holder to cover the fixed blade and the movable blade, and wherein the blade holder has a primary retainer member holding end portions of the pressing spring and the blade cover has a secondary retainer member pressing the end portions of the pressing spring in a direction in which the pressing spring is retained by the primary retainer member.

With this configuration, the end portions of the pressing spring are retained in place by the primary retainer member of the blade holder while assembling the blade block. After the blade holder and the blade cover are assembled together, the end portions of the pressing spring are pressed by the secondary retainer member of the blade cover in a direction in which the pressing spring is retained by the primary retainer member. When compared to the prior art, this makes it possible to increase the pressing force applied to the movable blade by the pressing spring. Accordingly, it is possible to apply a stable pressing load to the movable blade against the fixed blade.

In accordance with the embodiment of the present invention, the blade base is formed of the blade holder and the blade cover which are formed separately. The end portions of the pressing spring are retained by the primary retainer member of the blade holder and are pressed by the secondary retainer member of the blade cover in the direction in which the pressing spring is retained by the primary retainer member. Therefore, the pressing force applied to the movable blade by the pressing spring can be increased by the double retaining structure offered by the primary retainer member and the secondary retainer member. This ensures that a stable pressing load is applied to the movable blade against the fixed blade. As a result, it becomes possible to provide a blade block that can improve the cutting performance of the hair clipper and is strong, robust, and durable even in unfriendly environment.

BRIEF DESCRIPTION OF THE DRAWINGS

The objects and features of the present invention will become apparent from the following description of embodiments given in conjunction with the accompanying drawings, in which.

DETAILED DESCRIPTION OF THE EMBODIMENTS

Hereinafter, the present invention will be described with reference to the accompanying drawings which form a part hereof.

Figure 3A:
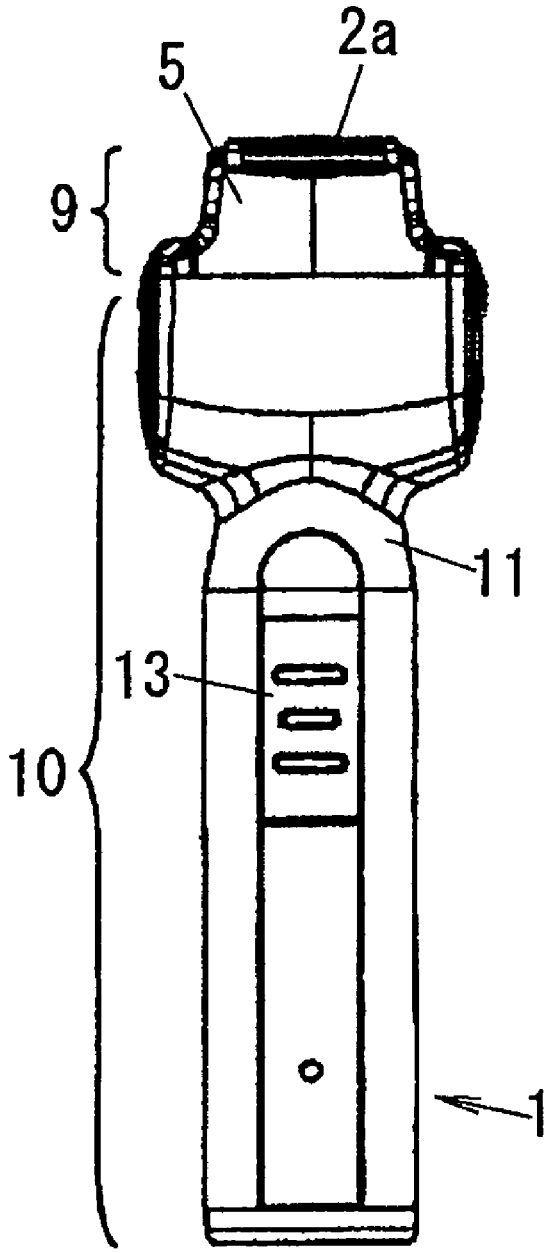
FIGS. 3A, 3B and 3C are front, side and cross sectional side views of the hair clipper, respectively.
Figure 3B:
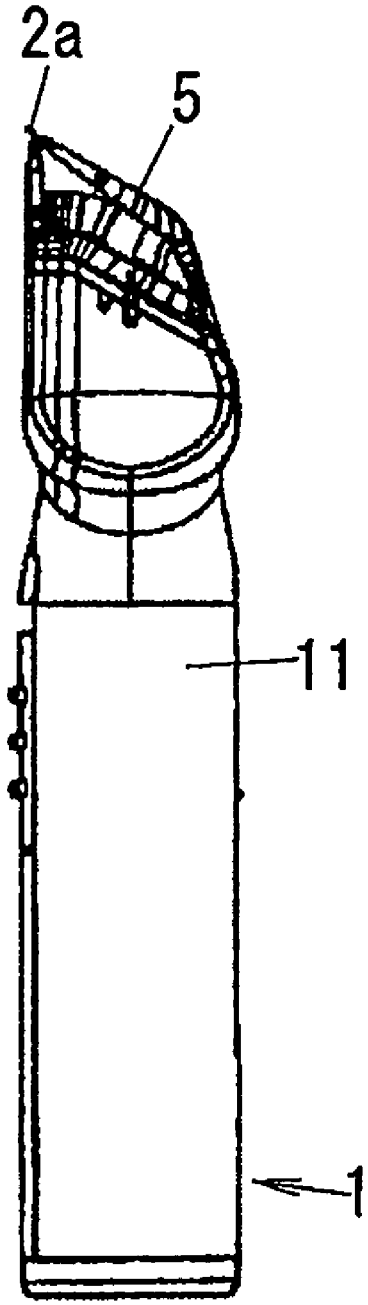
Figure 3C:
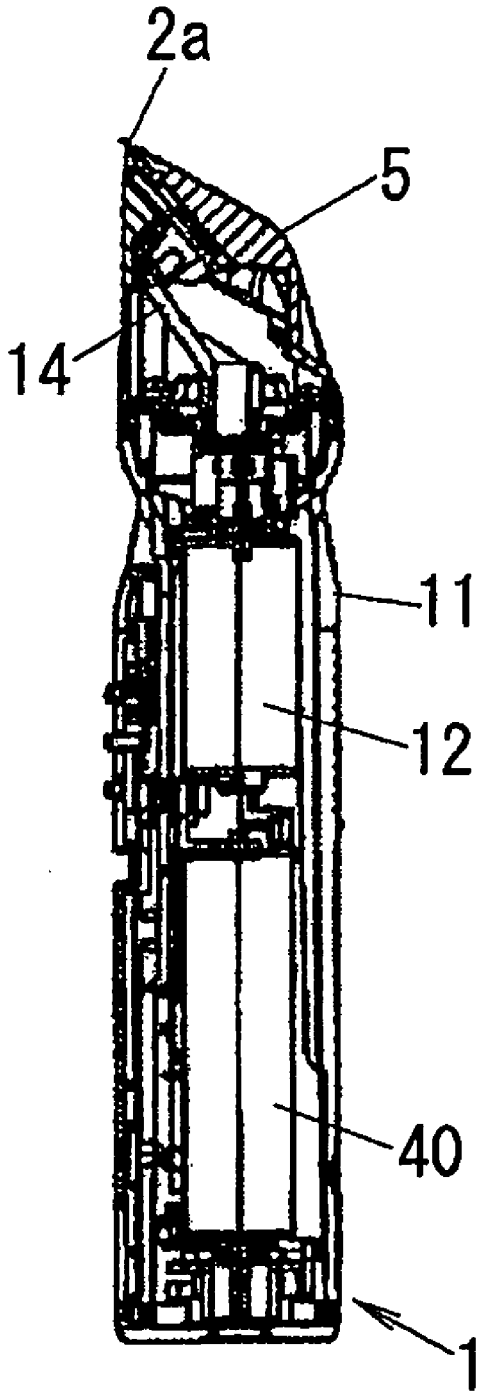
Figure 4A:
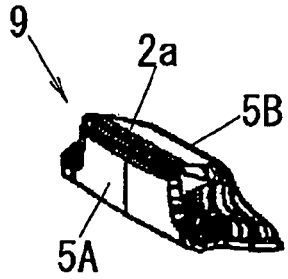
FIGS. 4A to 4E are perspective, front, plan, side and cross sectional side views of the blade block, respectively.
Figure 4B:
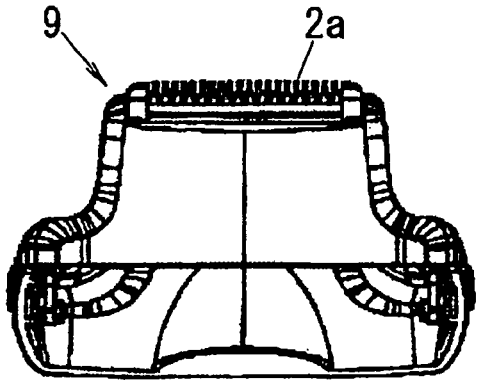
Figure 4C:
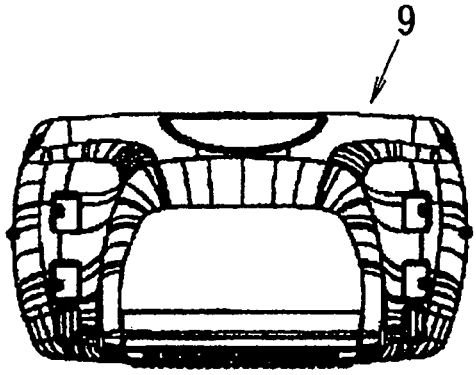
Figure 4D:
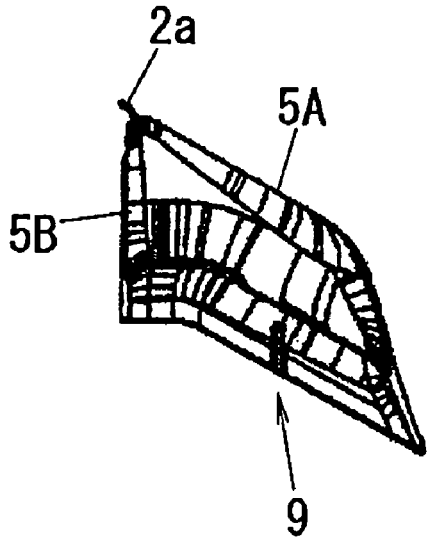
Figure 4E:
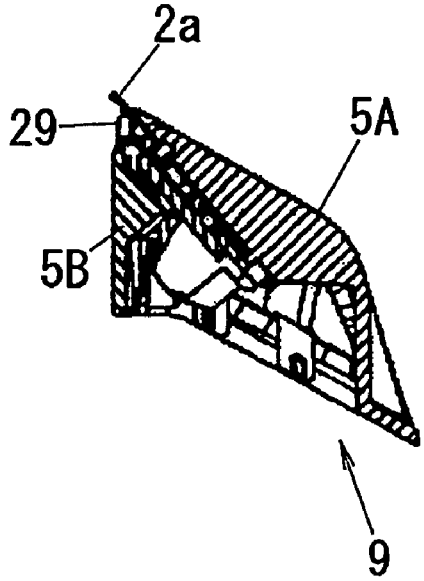

Referring to FIG. 3, a hair clipper 1 of the present invention includes a main body block 10 having a contour of a grip shape and a blade block 9 attached to a top portion of the main body block 10.

The main body block 10 includes a housing 11, a motor 12 accommodated in the housing 11 and a battery 40 accommodated in the housing 11 for supplying electric power to the motor 12. A power transmitting mechanism 14 for transmitting drive force from the motor 12 to a movable blade 3 is connected to a shaft of the motor 12. A portion of the surface of the main body block 10 forms a grip having a switch 13. By manipulating the switch 13 to be on, the electric power from the battery 40 is supplied to the motor 12 which in turn imparts reciprocating movement to the movable blade 3 through the power transmitting mechanism 14, thereby cutting hairs.

Figure 1:
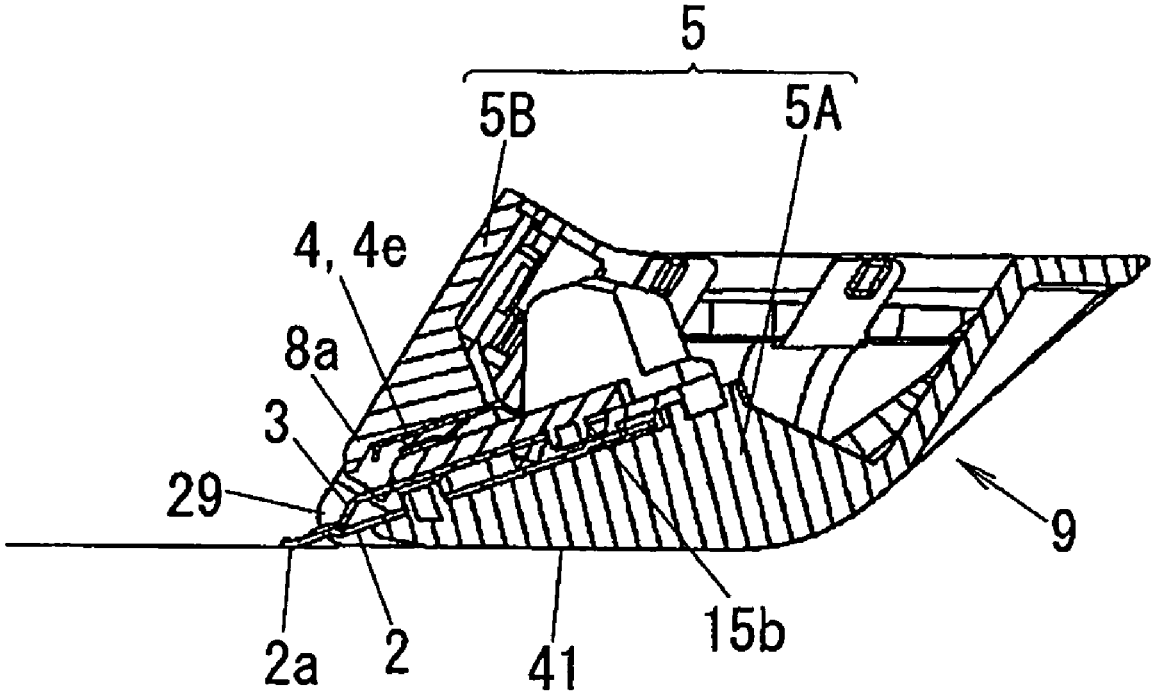
FIG. 1 is a cross sectional side view showing a blade block of a hair clipper in accordance with a first embodiment of the present invention.
Figure 5:
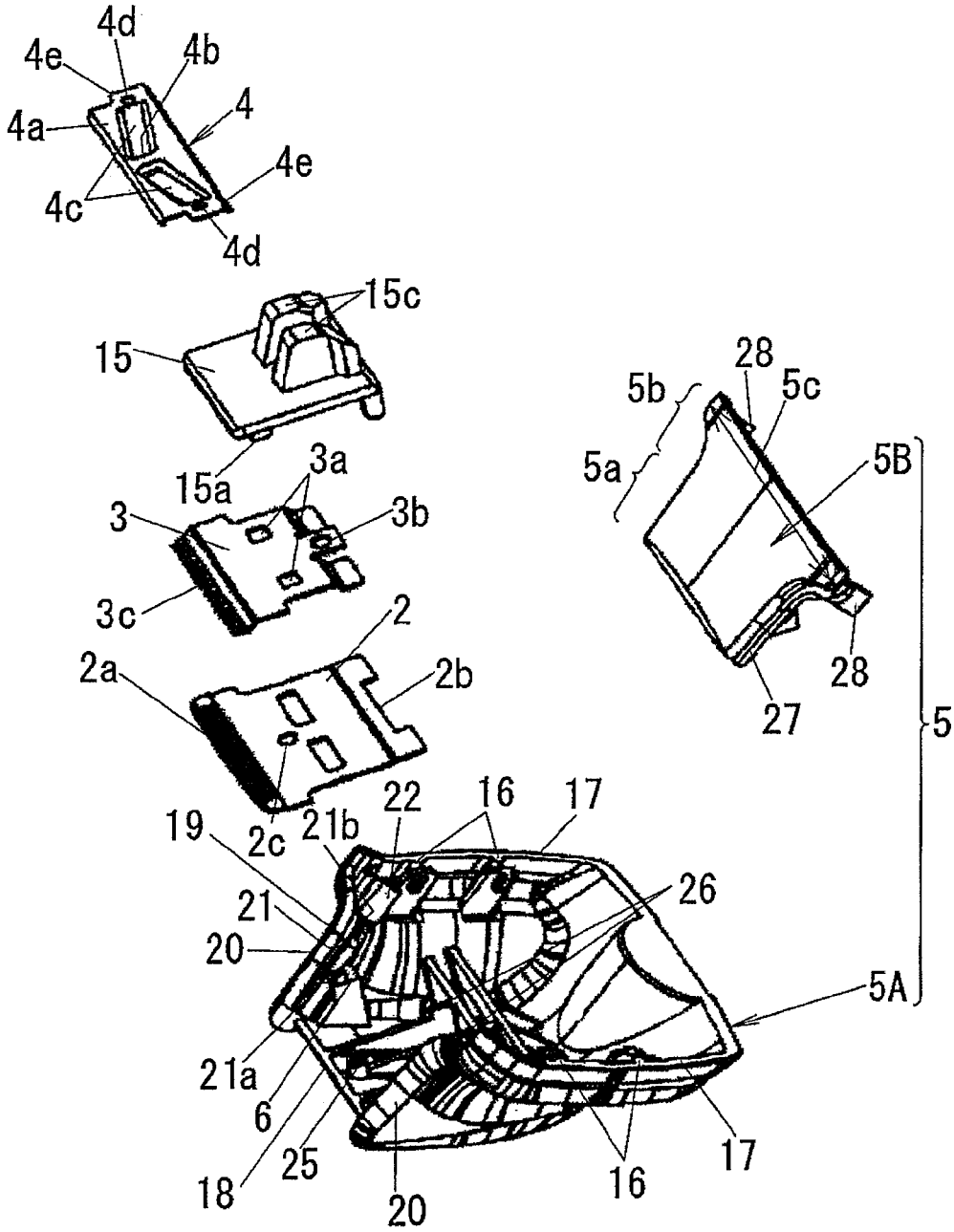
FIG. 5 is an exploded perspective view of the blade block.

As shown in FIGS. 1, 4 and 5, the blade block 9 includes a comb-shaped fixed blade 2; the comb-shaped movable blade 3 arranged on the top surface of the fixed blade 2; a guide plate 15 through which the reciprocating movement of the power transmitting mechanism 14 of the main body block 10 is transmitted to the movable blade 3; a pressing spring 4 arranged on the top surface of the guide plate 15 for applying a pressing load to the movable blade 3 through the guide plate 15; and a blade base 5 for accommodating the fixed blade 2, the movable blade 3 and the pressing spring 4 and the guide plate 15. The movable blade 3 makes reciprocating movement in a state that it is pressed against the fixed blade 2 by means of the pressing spring 4, whereby the hairs lying between a comb-shaped blade edge portion 2*a* of the fixed blade 2 and a comb-shaped blade edge portion 3*c* of the movable blade 3 are cut.

The blade base 5 is divided into a blade holder 5A, which holds the fixed blade 2 and the movable blade 3, and a blade cover 5B attached to the blade holder 5A for covering the fixed blade 2 and the movable blade 3, the blade holder 5A and the blade cover 5B being formed separately.

The blade holder 5A is detachably attached to the main body block 10 by means of an attachment member. The attachment member may be of the type having a plurality of elastic locking portions (designated by reference numeral 16 in FIG. 5) which are provided in an upper opening edge 17 of the blade holder 5A and elastically engaged with a top protruding wall portion (not shown) of the main body block 10. Alternatively, the blade holder 5A may be attached to the main body block 10 in place by fitting the upper opening edge 17 of the blade holder 5A and the top abutting surface of the main body block 10 in a protrusion and recess fitting manner. The attachment member for the blade holder 5A is not limited to the above-described configurations but may be appropriately modified in design.

The outer peripheral surface of the blade holder 5A has a smooth skin contact surface 41. The fixed blade 2, the movable blade 3, the guide plate 15 and the pressing spring 4 are received within the blade holder 5A. In the example shown in FIG. 5, sidewall portions 19 are formed at the left and the right end portion of a lower wall portion 18 of the blade holder 5A. A blade cover attachment groove 21 and a blade cover attachment plate 22 are provided at a front end portion 20 of each of the sidewall portions 19.

The blade cover attachment groove 21 is formed at the upper half portion of the front end portion 20 and the blade cover attachment plate 22 is formed at the lower portion of the front end portion 20. The blade cover attachment groove 21 has a substantially "U" shaped cross section opened toward the blade cover attachment groove 21 at the opposite side. A front sidewall 21*a* of the blade cover attachment groove 21 runs substantially parallel to the front edge of the sidewall portion 19, but a top portion of a rear side wall 21*b* of the blade cover attachment groove 21 is bent backward.

The blade cover attachment plate 22 is integrally formed with the inner surface of each sidewall portion 19 of the blade holder 5A and has a slit 23 and protruding portions 24 protruding into the slit 23. The slit is extended along an attachment direction of the blade cover 5B and opened in a forward, a backward and an upward direction. The blade cover attachment plate 22 is arranged in such a position as not to block the rear sidewall 21*b* of the blade cover attachment groove 21. In the present embodiment, the lower portion of the front end portion 20 of the blade holder 5A is of an outwardly expanded shape and the blade cover attachment plate 22 is arranged inside the outwardly expanded portion in such a way that the blade cover attachment plate 22 does not block the rear sidewall 21*b* of the blade cover attachment groove 21.

In the example shown in FIG. 5, a front boss 25 to which a boss-hole 2*c* of the fixed blade 2 fitted and secured is provided in the center portion of the lower wall portion 18 of the blade holder 5A. Provided at the rear side of the boss 25 is a pair of left and right positioning ribs 26 which is fitted into a rear cutout portion 2*b* of the fixed blade 2. The boss 25 and the positioning ribs 26 form a fixing member for fixing the fixed blade 2 to the blade holder 5A.

The movable blade 3 is mounted on top of the fixed blade 2 and the guide plate 15 is arranged on top of the movable blade 3. The guide plate 15 serves to transfer the reciprocating movement of the power transmitting mechanism 14 of the main body block 10 to the movable blade 3. In the example shown in FIG. 5, an engaging ribs 15*c* with which the power transmitting mechanism 14 is engaged protrude from the top surface of the guide plate 15 and a plurality of coupling lugs 15*a* and 15*b* (two front coupling lugs 15*a* and one rear coupling lug 15*b* in the present example) (see FIG. 1) is formed on the bottom surface of the guide plate 15. The two front coupling lugs 15*a* are fitted to two front holes 3*a* of the movable blade 3 and the one rear coupling lug 15*b* is fitted to a rear hole 3*b* of the movable blade 3.

The pressing spring 4 for resiliently pressing the guide plate 15 against the movable blade 3 is arranged on top of the guide plate 15. The pressing spring 4 includes a spring plate 4*a* manufactured by cutting and press forming, e.g., a metal sheet by using a die. In the example shown in FIG. 5, the pressing spring 4 further includes a pair of elastic pressing pieces 4*c* by cutting and erecting two longitudinally spaced apart regions of the generally rectangular spring plate 4*a*; a central crosspiece 4*b* left intact between the longitudinally spaced apart regions; and boss-holes 4*d* in the longitudinal opposite end portions of the spring plate 4*a*. The pair of elastic pressing pieces 4*c* are bent downward to have a generally "V" shape with the vertex being omitted when seen from the front side. For instance, each of the two longitudinally spaced apart regions has four edges and all edges excepting two longitudinally opposite edges of the two regions are cut from the spring plate 4*a* and bent downward.

As will be described later, two opposite end portions 4*e* of the pressing spring 4 are adapted to be retained in place by a primary retainer member 7 provided at the blade holder 5A and a secondary retainer member 8 provided at the blade cover 5B. The elastic pressing pieces 4*c* of the pressing spring 4 are elastically deformable in a direction perpendicular to the thickness direction of the spring plate 4*a*. By allowing the tip ends of the elastic pressing pieces 4*c* to press the central region of the top surface of the guide plate 15, a constant pressing load is applied to the movable blade 3 against the fixed blade 2 through the guide plate 15. Therefore, the movable blade 3 on the fixed blade 2 is kept slidable with no gap between the comb-shaped blade edge 3*c* of the movable blade 3 and the comb-shaped blade edge 2*a* of the fixed blade 2.

Figure 6A:
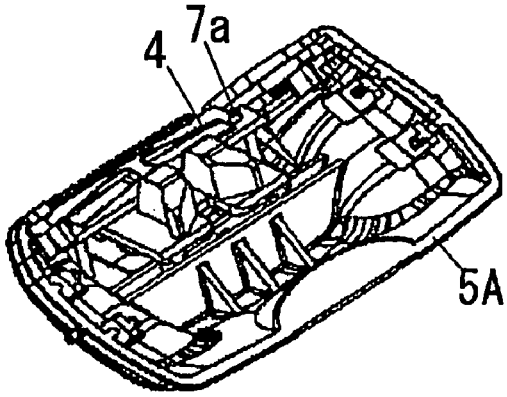
FIG. 6A is a perspective view of a blade holder employed in the hair clipper blade block shown in FIG. 1, FIGS. 6B and 6C are views for explaining the retaining operation performed by a primary retainer member
Figure 6B:
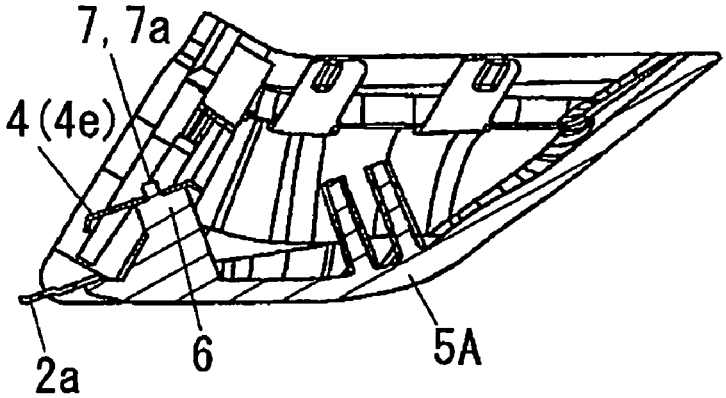
FIG. 6D is a view for explaining the retaining operation performed by a secondary retainer member.
Figure 6C:
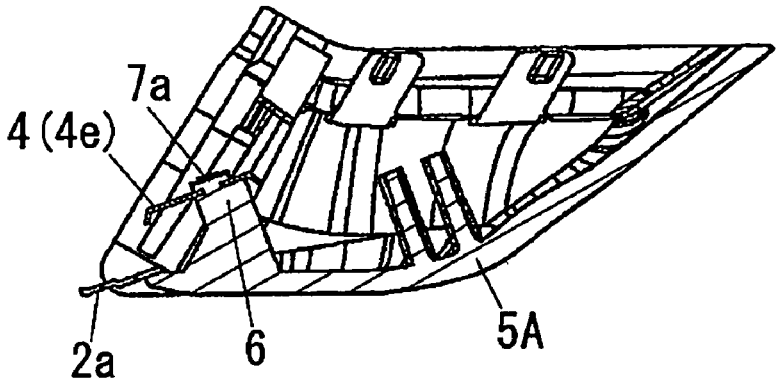

The blade holder 5A is provided with a pair of left and right spring rests 6 for respectively receiving the left and the right end portion 4*e* of the pressing spring 4. In the example shown in FIG. 5, the spring rests 6 are provided at the left and the right end portion of the lower wall portion 18 of the blade holder 5A. A boss 7*a* constituting a part of the primary retainer member 7 protrudes from the central portion of each spring rest 6. As shown in FIGS. 6A to 6C, the end portions 4*e* of the pressing spring 4 are laid down on the spring rests 6 and the bosses 7*a* are fitted to the boss-hole 4*d* of the pressing spring 4. By upsetting or deforming an exposed free end of each boss 7*a* in this state, it becomes possible for the bosses 7*a* to retain the end portions 4*e* of the pressing spring 4 in place.

Referring back to FIG. 5, the blade cover 5B has a generally rectangular plate-like front portion 5*a* and a rear portion 5*b* with a wide breadth rear portion 5*c* whose breadth is greater than that of the front portion 5*a*. A fin portion 27 protrudes from each flank side of the front portion 5*a* of the blade cover 5B so that it can be slidably fitted to the blade cover attachment groove 21 of the blade holder 5A.

Figure 7A:
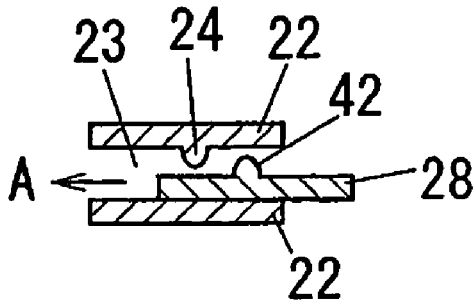
FIGS. 7A and 7B are views for explaining the manner in which a blade cover is retained by a blade cover attachment hook which prevents the removal of the blade cover.
Figure 7B:
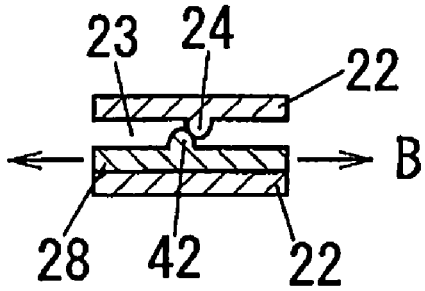

A pair of left and right insertion pieces 28, which can be inserted into the slits 23 of the blade cover attachment plate 22, protrude from the two opposite end portions of the wide breadth rear portion 5*c* of the blade cover 5B in a backward direction of the blade cover 5B. Lock portions 42 (see FIG. 7) protrude from the inner surfaces of the insertion pieces 28. When the insertion pieces 28 having the lock portions 42 are inserted into the slits 23 of the blade cover attachment plate 22, the lock portions 42 ride over the protruding portions 24 projected into the slits 23 and to make hooking engagement with the protruding portions 24. This keeps the insertion pieces 28 from being removed out of the slits 23.

Figure 6D:
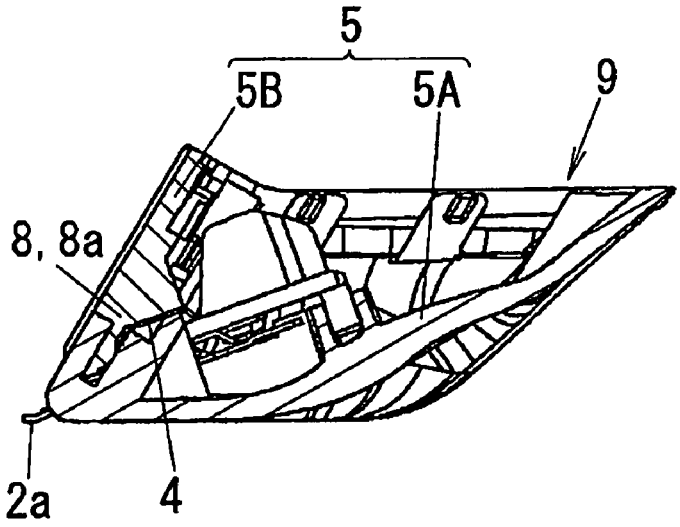

The blade cover 5B includes a secondary retainer member 8 for pressing the left and right end portions 4*e* of the pressing spring 4 in a direction in which the pressing spring 4 is retained by the boss 7*a* (the primary retainer means 7), i.e., in a direction toward the spring rests 6 of the blade holder 5A or the movable blade 2. In the present embodiment, a spring push surface 8*a* constituting the secondary retainer member 8 is formed at each of the left and right end portions of a rear surface of the blade cover 5B. As shown in FIG. 6D, the spring push surfaces 8*a* are of such a shape that, when the blade cover 5B is attached to the blade holder 5A, they can press the peripheral portions of the boss-holes 4*d* formed at the end portions 4*e* of the pressing spring 4 toward the spring rests 6. Each spring push surface 8*a* can be a flat surface of formed of one or more protrusions to be in touch with the end portion 4*e*.

The blade block 9 configured as above is assembled in the following manner. First, the fixed blade 2, the movable blade 3 and the guide plate 15 are received and stacked on atop another in that sequence in the blade holder 5A. In a state that the elastic pressing pieces 4*c* of the pressing spring 4 face the top surface of the guide plate 15, the boss-holes 4*d* formed at the opposite end portions 4*e* of the pressing spring 4 are fitted to the left and right bosses 7*a* protruding from the opposite end portions of the lower wall portion 18 of the blade holder 5A, thereby positioning the pressing spring 4 in the spring rests 6 (FIG. 6B). In this state, exposed free end portions of the bosses 7*a* are upsetted or deformed by cold or hot working to fix the pressing spring 4 in place (FIG. 6C). This prevents the pressing spring 4 from escaping out of the bosses 7*a* in the upward direction.

In this state, the blade cover 5B is attached to the blade holder 5A. Specifically, the fin portions 27 of the blade cover 5B are slidingly inserted into the blade cover attachment grooves 21 of the blade holder 5A and, at the same time, the insertion pieces 28 of the wide breadth rear portion 5*c* of the blade cover 5B are inserted along the slits 23 of the blade cover attachment plate 22 of the blade holder 5A in the direction indicated by an arrow "A" in FIG. 7A, whereby the insertion pieces 28 are locked by the blade cover attachment plate 22 against removal in the direction indicated by an arrow "B" in FIG. 7B. At this time, the spring push surfaces 8*a* of the rear surface of the blade cover 5B come into a state that they press the peripheral portions of the boss-holes 4*d* of the pressing spring 4 toward the spring rests 6 (the state shown in FIG. 6D).

When the blade base 5 is assembled in this manner, a transversely extending slot-like blade protruding hole 29 (see FIG. 2) is formed at the front end corner portion of the blade base 5 and the comb-shaped blade edge portions 2*a* and 3*c* project outwardly from the inside of the blade base 5 through the blade protruding hole 29. This makes it possible to obtain the blade block 9 optimized for cutting, e.g., curly hairs or short hairs growing along the edge of the scalp.

In the course of assembling the blade block 9, the pressing spring 4 is retained in place by upsetting the exposed free end portion of the bosses 7*a* (the primary retainer member 7) provided at the spring rests 6 of the blade holder 5A. However, due to variations occurring during upsetting process, e.g., non-uniform deformation of the bosses 7*a* or the like, the pressing spring 4 may possibly float or move upward while being hold by the bosses 7*a*. Further, if the hair clipper experiences elevated temperate for a long time while being circulated in the market or being used, the deformed bosses 7*a* may undergo creep deformation even though the pressing spring 4 was fixedly held by the bosses 7*a* at the beginning, resulting in the floating of the pressing spring 4 as well.

In the present invention, the spring push surfaces 8*a* (the secondary retainer member 8) as well as the primary retainer member 7 are provided in the blade cover 5B formed independently of the blade holder 5A so that, when the blade cover 5B is attached to the blade holder 5A, the spring push surfaces 8*a* can provide an effect of pushing down the pressing spring 4. This makes it possible to reliably retain the opposite end portions 4*e* of the pressing spring 4 not to move upward.

Figure 2A:
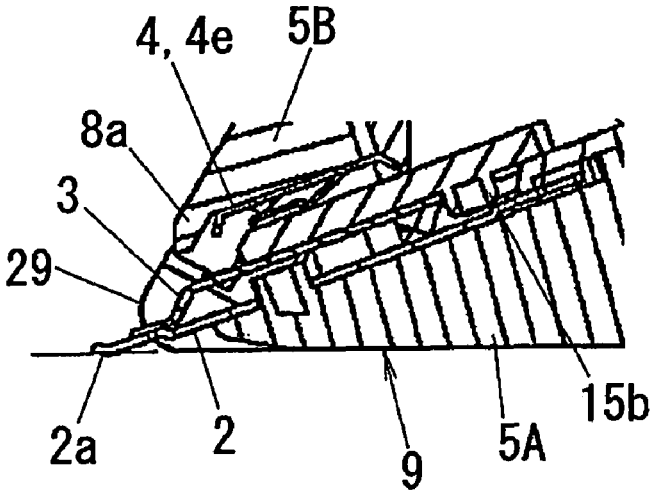
FIGS. 2A and 2B are views for explaining the movement of a comb shaped blade edge portion of a fixed blade when the blade block is in use.
Figure 2B:
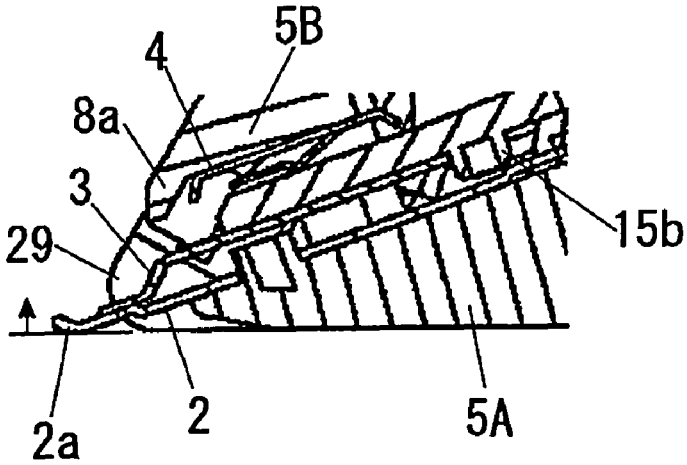

In other words, the retaining force of the pressing spring 4 is increased by the double retaining structure offered by the primary retainer member 7 and the secondary retainer member 8. Therefore, even when the comb-shaped blade edge portion 2*a* is bent in parallel with the skin contact surface 41 as shown in FIG. 2A or bent upwardly from the skin contact surface 41 as indicated by an arrow in FIG. 2B, the pressing force applied to the movable blade 3 by the pressing spring 4 can be kept high enough to stably apply a pressing load to the movable blade 3 against the fixed blade 2. As a result, it becomes possible to obtain the blade block 9 that can improve the cutting performance of the hair clipper and is strong, robust and durable even in unfriendly environment.

When the blade cover 5B is attached to the blade holder 5A, the insertion pieces 28 with the lock portions 42 provided at the wide breadth rear portion 5*c* of the blade cover 5B are locked to the blade cover attachment plate 22 of the blade holder 5A in a removal-proof manner merely by slidingly fitting the fin portions 27 formed at the front portion of the blade cover 5B to the blade cover attachment grooves 21 of the blade holder 5A. Accordingly, the task of attaching the blade cover 5B to the blade holder 5A becomes quite simple and reliable, thus providing an advantage in that the assembly works can be done in a relatively easy manner.

Figure 8:
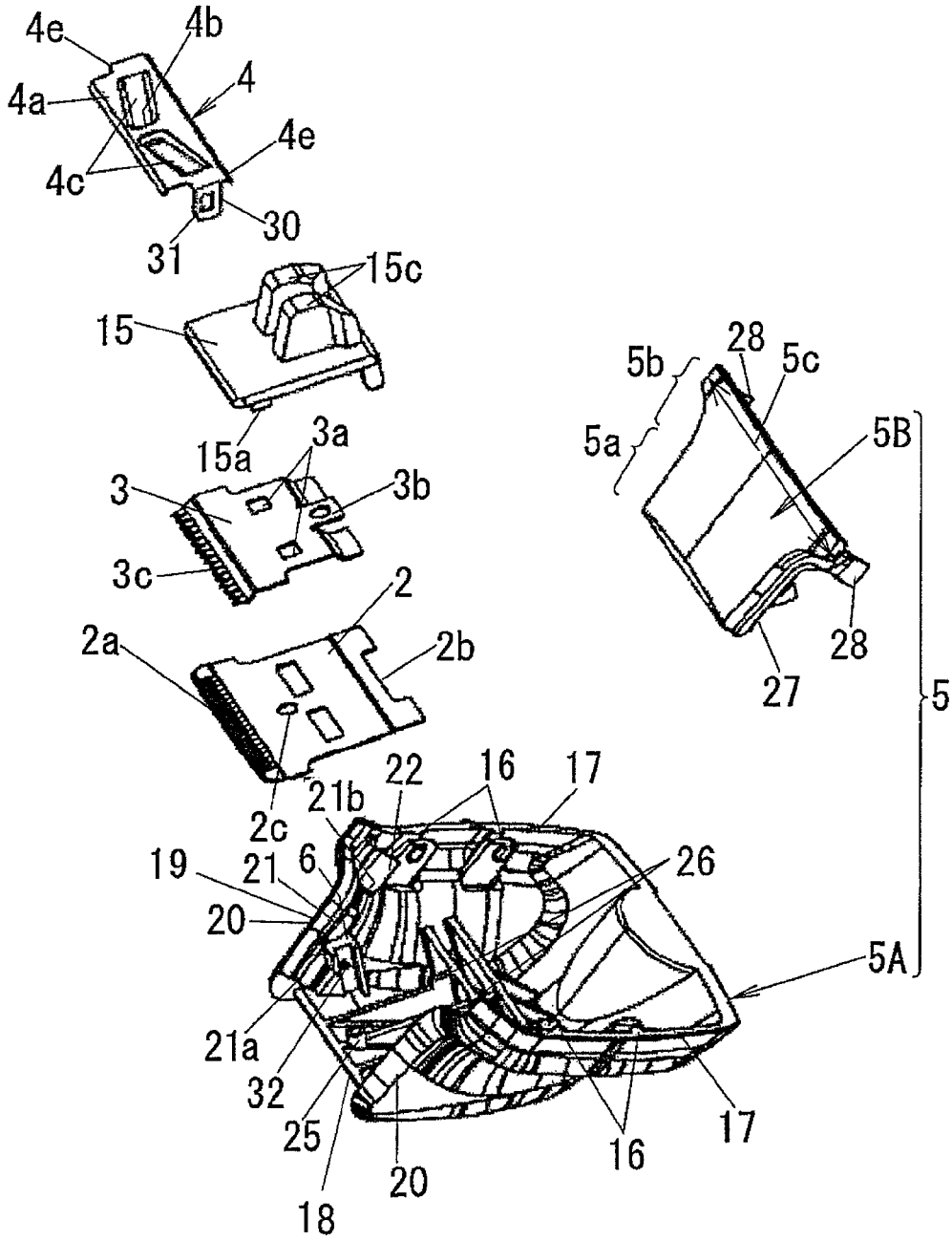
FIG. 8 is an exploded perspective view of a hair clipper blade block in accordance with a second embodiment of the present invention.
Figure 9A:
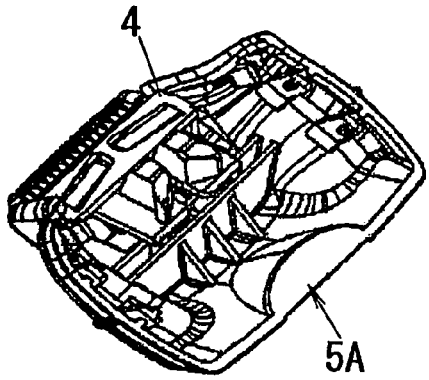
FIG. 9A is a perspective view of a blade holder employed in the hair clipper blade block shown in FIG. 8.
Figure 9B:
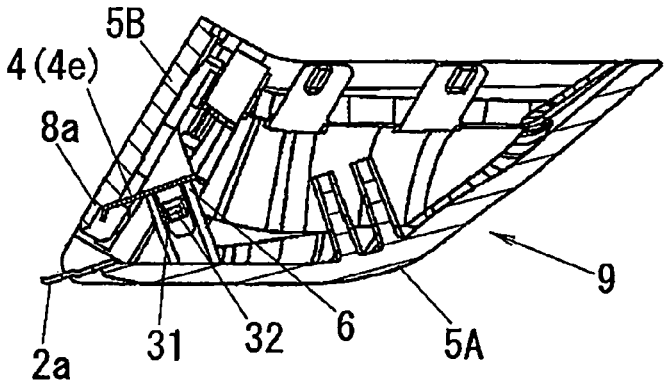
FIG. 9B is a view for explaining the retaining operation performed by a primary retainer member in the second embodiment.
Figure 9C:
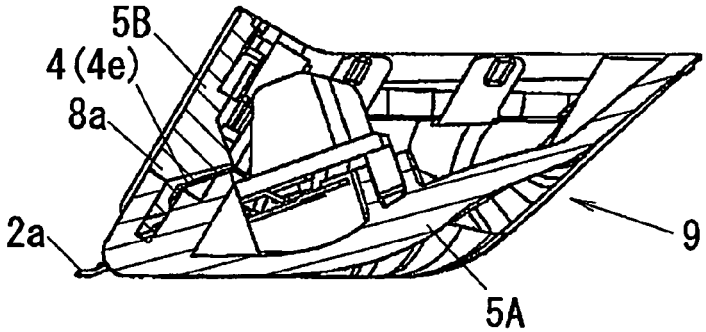
FIG. 9C is a view for explaining the retaining operation performed by a secondary retainer member in the second embodiment.

FIGS. 8 and 9 illustrate another embodiment of the present invention. In this embodiment, wing plate portions 30 serving as the primary retainer member 7 protrude from the lower surfaces of the opposite end portions 4*e* of the pressing spring 4 toward the lower wall portion 18 of the blade holder 5A. A fixing hole 31 opened in a transverse direction is formed through each of the wing plate portions 30. Engaging lugs 32 protrude in a transverse direction from the inner side surfaces of the left and right spring rests 6 provided at the left and right end portions of the lower wall portion 18 of the blade holder 5A. As in the preceding embodiment, the secondary retainer member 8 is of a structure pushing the pressing spring 4 toward the spring rests 6 by the spring push surfaces 8*a* provided at the blade cover 5B. Corresponding parts to the preceding embodiment are designated by like reference characters and no detailed description will be made in that regard.

In the present embodiment, the opposite end portions 4*e* of the pressing spring 4 can be kept from floating upwardly from the spring rests 6, merely by placing the opposite end portions 4*e* of the pressing spring 4 on the upper surfaces of the spring rests 6 and interlocking the fixing holes 31 of the wing plate portions 30 and the engaging lugs 32 protruding from the inner side surfaces of the spring rests 6. Consequently, use of the primary retainer member 7 of the second embodiment makes it possible to omit the upsetting process of the exposed free end portion of the bosses 7*a* (see FIG. 6B) required in the preceding embodiment, which provides an advantage of simplifying the assembly works.

Although the afore-mentioned embodiments are directed to a structure in which the elastic pressing pieces 4*c* of the pressing spring 4 are pressed into close contact with the guide plate 15 to press the movable blade 3 through the guide plate 15, it may be possible, as an alternative example, to employ a configuration in which the movable blade 3 is directly pressed by the elastic pressing pieces 4*c*.

While the invention has been shown and described with respect to the embodiments, it will be understood by those skilled in the art that various changes and modifications may be made without departing from the scope of the invention as defined in the following claims.

What is claimed is:

1. A hair clipper having a blade block, the blade block comprising:

a fixed blade;

a movable blade overlapped with the fixed blade to make sliding contact with the fixed blade;

a pressing spring applying a pressing load to maintain a uniform contact pressure between the fixed blade and the movable blade; and a blade base for receiving and retaining the fixed blade, the movable blade and the pressing spring, wherein the blade base includes a blade holder retaining the fixed blade and the movable blade and a blade cover attached to the blade holder to cover the fixed blade and the movable blade, wherein the blade holder has a primary retainer member engaged with end portions of the pressing spring and the blade cover has a secondary retainer member pressing the end portions of the pressing spring toward the movable blade.

2. The hair clipper having the blade block of claim 1, wherein the blade holder and the blade cover are formed separately.

3. The hair clipper having the blade block of claim 1, wherein a boss hole is provided at each of the end portions of the pressing spring and a boss is disposed at a spring rest provided at a bottom of the blade holder, the boss being fitted into the boss hole and an exposed free end of the boss being upsetted.

4. The hair clipper having the blade block of claim 1, wherein the primary retainer member contacts the end portions of the pressing spring to provide the engagement of the primary retainer member with the end portions of the pressing spring.

5. The hair clipper having the blade block of claim 1, wherein a wing plate portion protrudes at each of the end portions of the pressing spring toward the fixed blade, the wing plate portion having a hole, and the primary retainer member has a lug disposed at each of inner side surfaces of spring rests provided at an upper portion of the blade holder, the lug being engaged with the hole of the wing plate portion.

6. The hair clipper having the blade block of claim 5, wherein the secondary retainer member includes spring push surfaces disposed at each of end portions of a rear surface of the blade cover, wherein the spring push surfaces press the end portions of the pressing spring toward the spring rests.

7. The hair clipper having the blade block of claim 5, wherein the lug protrudes in a transverse direction from said each of the inner side surfaces of the spring rests, and the hole is opened in a transverse direction of the wing plate portion.

* * * * *